United States Patent [19]

Theurer

[11] 4,430,944

[45] Feb. 14, 1984

[54] MOBILE APPARATUS AND METHOD FOR CLEANING BALLAST SUPPORTING A TRACK

[75] Inventor: Josef Theurer, Vienna, Austria

[73] Assignee: Franz Plasser Bahnbaumaschinen-Industriegesellschaft m.b.H., Vienna, Austria

[21] Appl. No.: 232,883

[22] Filed: Feb. 9, 1981

[30] Foreign Application Priority Data

Feb. 25, 1980 [AT] Austria ..... 1043/80

[51] Int. Cl.[3] ..... E01B 27/10; E01B 27/17

[52] U.S. Cl. ..... 104/7 R; 104/2; 171/16

[58] Field of Search ..... 104/2, 7 R, 7 B, 12; 171/16; 37/104–107

[56] References Cited

U.S. PATENT DOCUMENTS

| | | | |
|---|---|---|---|
| 3,710,721 | 1/1973 | Stewart | 104/12 |
| 4,010,691 | 3/1977 | Theurer et al. | 104/7 A |
| 4,257,331 | 3/1981 | Theurer et al. | 104/2 |

FOREIGN PATENT DOCUMENTS

| | | | |
|---|---|---|---|
| 298546 | 9/1971 | Austria | 104/12 |

*Primary Examiner*—Randolph Reese

*Attorney, Agent, or Firm*—Kurt Kelman

[57] ABSTRACT

A mobile apparatus for cleaning ballast supporting a track comprises a train arranged for non-stop movement on the track. The train includes a ballast cleaning machine with a track lifting mechanism, a series of freight cars arranged to receive and transport the waste component from the cleaned ballast, and a ballast tamping machine arranged between the ballast cleaning machine and the series of freight cars, the tamping machine comprising an additional track lifting mechanism and a tamping head capable of intermittent movement along the track. The waste component is conveyed from the ballast cleaning machine to respective freight cars by a first conveyor section arranged to convey the waste component along the series of freight cars and a second conveyor section arranged on the tamping machine. The second conveyor section has an input adjacent the ballast cleaning machine and arranged to receive the waste component therefrom, and an output adjacent the input of the first conveyor section and arranged to deliver the waste component thereto.

11 Claims, 3 Drawing Figures

MOBILE APPARATUS AND METHOD FOR CLEANING BALLAST SUPPORTING A TRACK

Figures 1, 2, 3:
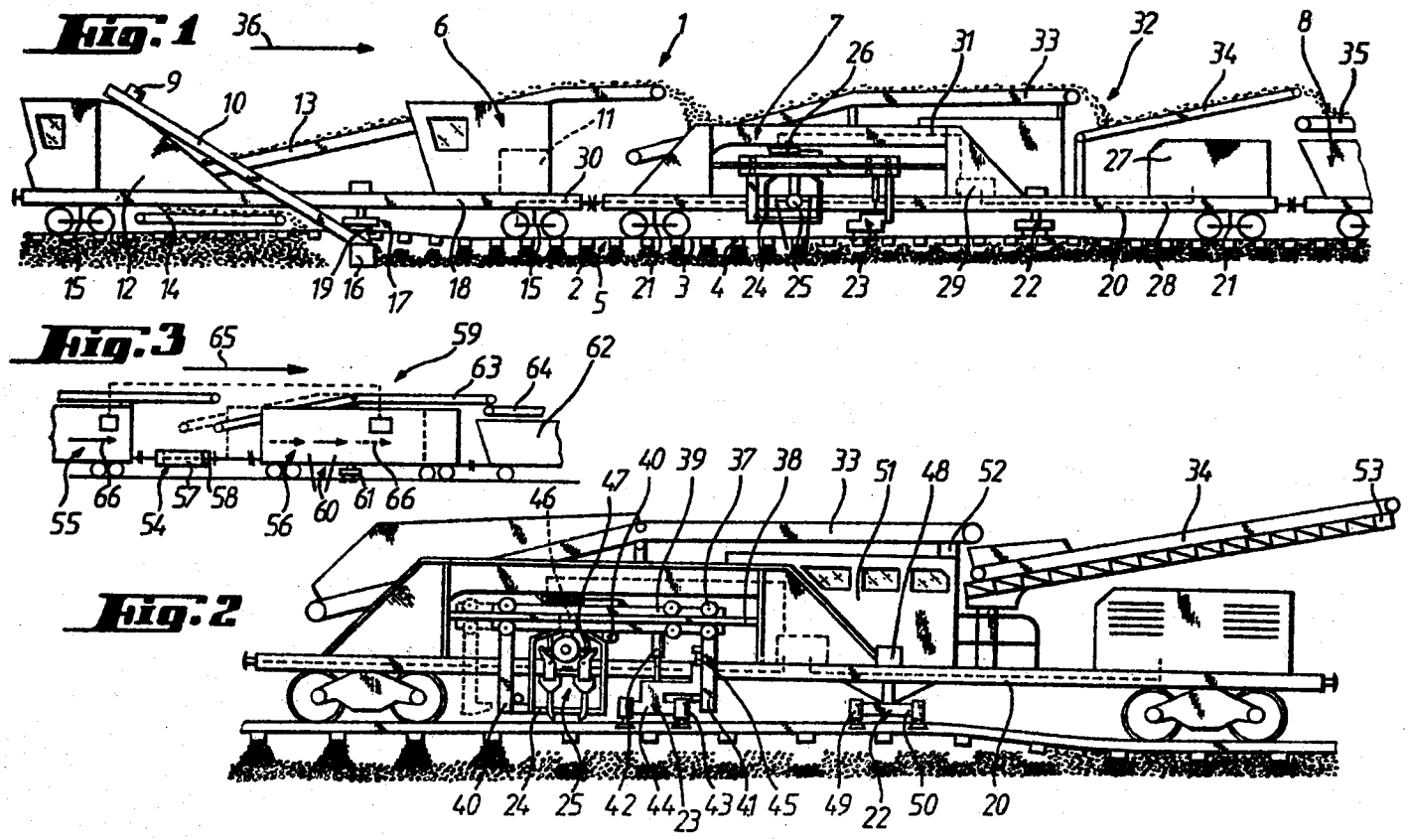

The present invention relates to a mobile apparatus and a method for cleaning ballast supporting a track, the mobile apparatus comprising a train arranged for non-stop movement on the track. The train includes a ballast cleaning machine comprising a track lifting mechanism and means for cleaning the ballast and for separating the cleaned ballast from a waste component, a series of freight cars arranged to receive and transport the waste component, and a conveyor means for conveying the waste component from the ballast cleaning machine to respective ones of the freight cars.

U.S. Pat. No. 4,010,691, dated Mar. 8, 1977, discloses a ballast cleaning machine with conveyor means arranged to convey separate waste or rubble either to the front or rear end of the machine to be received by freight cars that may be coupled to the machine. A track lifting mechanism is mounted on the machine between the front and rear undercarriages supporting the machine for non-stop movement on the track and a ballast excavating unit is arranged on the machine frame to operate in the range of the track lifting mechanism. The excavating unit comprises an endless chain having a run extending transversely of, and underneath, the track and having ballast entrainment members that usually have a height of about 30 cm to enable the ballast to be removed in a useful manner from underneath the track. The track is lifted sufficiently to accommodate this transverse excavating chain run but, at a constant spacing of the undercarriages from each other, it is not desirable to lift the track more than a given amount since such arching of the track rails between the undercarriages may lead to permanent rail deformations if the limit of elasticity of the rails is exceeded. This may cause particular difficulties when the ballast bed under a given track section is relatively shallow and the height of the ballast entrainment members under such conditions limits the usefulness of the machine because the required track lift may subject the rails to a degree of flexing exceeding their elasticity, causing permanent rail deformations.

U.S. Pat. No. 3,710,721, dated Jan. 16, 1973, discloses a ballast tamping machine comprising a tamping head. The machine with its tamping head is capable of intermittent movement along the track for tamping the ballast under successive track ties.

Austrian Pat. No. 298,546, published Sept. 15, 1971, discloses a track maintenance machine which moves intermittently along a track and which comprises a trailer adjustably coupled to the intermittently moving machine, the trailer being capable of moving continuously during the intermittent movement of the machine and carrying rollers for compacting the ballast shoulders.

It is the primary object of this invention to improve a ballast cleaning machine of the first indicated type so that it may be adapted for cleaning shallow ballast beds in a single pass without causing undue flexing of the track rails possibly leading to rail deformations.

According to one aspect of the invention, this and other objects are accomplished by arranging a ballast tamping machine between the ballast cleaning machine and the series of freight cars in the train, the ballast tamping machine comprising an additional track lifting mechanism and a tamping head capable of intermittent movement along the track. The conveyor means comprises a first conveyor means section arranged to convey the waste component along the series of freight cars and a second conveyor means section arranged on the tamping machine. The second conveyor means section has an input end adjacent the ballast cleaning machine and arranged to receive the waste component therefrom, and an output end adjacent an input end of the first conveyor means section and arranged to deliver the waste component thereto.

In accordance with another aspect of the present invention, a ballast cleaning method is provided wherein a first section of the track is lifted and the ballast is successively tamped under successive track ties of the lifted first track section as the ballast tamping proceeds intermittently in an operating direction from tie to tie. A ballast cleaning machine is moved non-stop on the track in the operating direction in a second and trailing track section while the track section is further lifted after the ballast has been tamped thereunder, the ballast is removed from under the lifted second track section, the removed ballast is cleaned and a waste component is separated from the cleaned ballast. The waste component is conveyed from the ballast cleaning machine over the first track section to a series of freight cars arranged to receive and transport the waste component ahead of the first track section, the freight cars moving non-stop with the ballast cleaning machine in the operating direction.

In this manner, the track is lifted successively in at least two stages during a single pass, which enables the necessary ultimate lift required for the cleaning operation to be attained while keeping each lift below a critical limit above which the elasticity of the track rails would be exceeded. The lifting mechanism on the track tamping machine enables the track to be lifted in an additional track section independently of the lift at the ballast cleaning machine. At this point, the track is lifted only a part of the lifting stroke required for the ballast cleaning and the ballast is tamped to fix the track at a provisional level.

The capability of the tamping head to move intermittently along the track may be accomplished in different ways. The ballast tamping machine comprises conventionally a frame mounted for mobility on the track and a tamping head mounted on the frame. In one embodiment, means may be provided for moving the tamping head along the frame intermittently with respect to the non-stop movement of the train. In this embodiment, the tamping machine frame moves non-stop with the train while the tamping head moving means enables the tamping head to be intermittently arrested for the duration of tamping the ballast under successive ties. Tamping machines of this type are known. In another embodiment, the tamping machine frame is adjustably coupled to the train whereby the tamping head on the frame is intermittently movable with respect to the non-stop movement of the train as the tamping machine frame is intermittently moved by the adjustable coupling. Such relative movements between frames coupled together in a train are known, for example, from the above-mentioned Austrian patent.

Thus, the mobile apparatus of this invention may be simply assembled with the use of generally conventional train components. It operates with unexpected economy because, despite the multi-stage lifting of the track during the cleaning operation, the waste component is conveyed and loaded simultaneously with the cleaning, without occupying a neighboring track and with a minimum of operating personnel.

The above and other objects, advantages and features of the invention will become more apparent from the following detailed description of certain now preferred embodiments thereof, taken in conjunction with the accompanying schematic drawing wherein FIG. 1 is a side elevational view of one embodiment of the mobile apparatus;

FIG. 2 is a like view, on an enlarged scale, of the tamping machine in the apparatus of FIG. 1; and FIG. 3 is also a side elevational view of another embodiment.

Referring first to FIGS. 1 and 2, the mobile apparatus for cleaning ballast 2 supporting a track consisting of rails 3 and successive ties 4 is shown to comprise train 1 arranged for non-stop movement on track 5 in an operating direction indicated by arrow 36. The train includes self-propelled ballast cleaning machine 6, a series of freight cars 8 arranged to receive and transport the waste component, and ballast tamping machine 7 arranged between the ballast cleaning machine and the series of freight cars. While only one freight car has been shown, any desired number of freight cars may be coupled to the train, depending on requirements.

The ballast cleaning machine is of the general type disclosed in U.S. Pat. No. 4,010,691 and comprises endless excavating chain 10 driven by hydraulic motor 9 and arranged in a well known manner to remove ballast 2 from under the track section lifted by track lifting mechanism 17. The removed ballast is conveyed by the excavating chain to means 12 for cleaning the ballast and for separating the cleaned ballast from a waste component, cleaning means 12 being constituted by a screening arrangement of any suitable known design. The cleaned ballast is returned to the track cribs by distributing conveyor 14 which is pivotal in a horizontal plane.

Ballast cleaning machine 16 has frame 18 mounted on undercarriages 15, 15 and vertically adjustable track lifting mechanism 17 is mounted on machine frame 18 between the undercarriage substantially above transverse run 16 of excavating chain 10 which extends underneath the track. The track lifting mechanism is preferably equipped with two roller clamps 19—only one being shown—which are pivotal transversely to the track for gripping the track rails.

Ballast tamping machine 7 has frame 20 mounted on front and rear swivel trucks 21, 21 for mobility on the track. Another track lifting mechanism 22 is mounted on machine frame 20 for common non-stop movement with the tamping machine and train 1, lifting mechanism 22 being fixed on machine frame 20 against longitudinal movement. Additional track lifting mechanism 23 is arranged on the ballast tamping machine for movement in a longitudinal direction relative to machine frame 20. Ballast tamping machine 7 further comprises a tamping head mounted on machine frame 20 and capable of intermittent movement along the track. The tamping head comprises carriage 24 and tamping unit 25 mounted on the carriage and including pairs of tamping tools for tamping ballast under successive ties when the tools are immersed in the ballast in a generally conventional manner.

In the embodiment of FIGS. 1 and 2, means is provided for moving the tamping head along frame 20 intermittently with respect to the non-stop movement of train 1, the illustrated moving means being hydraulic drive 26 for intermittently driving carriage 24 of the tamping head along the track. Central power plant 27 includes a source of hydraulic fluid and hydraulic fluid conduit 28 leads from the hydraulic fluid source to control 29. Branch conduit 30 leads from the control to drive 11 for driving the wheels of front undercarriage 15 of ballast cleaning machine 6 for moving train 1 non-stop on the track and another branch conduit 31 leads from the control to drive 26 for intermittently driving the tamping head along the track. Control 29 coordinates the intermittent drive with the non-stop drive according to a desired program to hold the tamping head in vertical registry with a respective tie 4 during tamping while train 1 continues to move non-stop along the track.

As is conventional in ballast tamping machines, a respective tamping head is associated with a respective rail 3 of track 5 and, in the illustrated embodiment, additional track lifting mechanism 23 is mounted on intermittently movable tamping head carriage 24 and tamping unit 25 is vertically movably mounted on the carriage. This construction enables the tamping machine to move non-stop with the train while simultaneously lifting a first section of the track and successively tamping the ballast under successive track ties of the lifted first track section as the ballast tamping proceeds intermittently in an operating direction from tie to tie as the tamping head is moved longitudinally relative to machine frame 20. The arrangement of other track lifting mechanism 22 frontward of the tamping heads in the direction of the non-stop movement has the advantage of starting the flexing line of the lifted rails during the operation closer to front swivel truck 21. This leaves the track rails free of tension and stress in the range of the ties being tamped and enables the track to rest securely on the tamped ballast supports under each tie. Furthermore, it enables the track to be gradually lifted where the lifting stroke is substantial. Control 29 coordinating the non-stop drive for the train and intermittent drive 26 for the tamping head provides a simple means for making the tamping independent from the speed of movement of train 1. When the speed of the train movement is increased, the control will deliver additional hydraulic fluid to drive 26 at the same time it delivers additional hydraulic fluid to the train drive so that the tamping head will be moved in relation to machine frame 20 at the same speed as the train movement.

As is shown in FIG. 1, endless conveyor band 13 is mounted on ballast cleaning machine 6 to receive the waste component from ballast screening arrangement 12 and to convey the waste component forwardly towards ballast tamping machine 7. The train further includes conveyor means for conveying the waste component from the ballast cleaning machine to respective ones of freight cars 8. This conveyor means comprises first conveyor means section 35 arranged to convey the waste component along the series of freight cars and second conveyor means section 32 arranged on tamping machine 7. The second conveyor means section has an input end adjacent ballast cleaning machine 6 and arranged to receive the waste component therefrom, and an output end adjacent an input end of first conveyor means section 35 and arranged to deliver the waste component thereto. In the illustrated embodiment, two endless conveyor bands 33, 34 independently mounted on ballast tamping machine 7 comprise second conveyor means section 32, endless conveyor band 33 having the input end and endless conveyor band 34 having the output end. While each endless conveyor band may be fixedly mounted on frame 20 of the tamping machine, it is preferred, as illustrated to mount endless conveyor band 34 pivotally on the tamping machine, one end of the endless conveyor band being supported on a pivot for swinging conveyor band 34 in a plane substantially parallel to track 5. Such conveyor means may be readily arranged on existing mobile tamping machines and enable the waste component to be readily conveyed from the ballast cleaning machine to the freight cars.

As more clearly shown in FIG. 2, carrier 40 supporting tamping head carriage 24 and carrier 41 vertically movably supporting additional track lifting mechanism 23 are affixed to sliding support 39 which is guided by rollers 37 along guide track 38, an end position of carrier 40 being illustrated in broken lines in this figure. Transverse beams supporting tamping head carriage 24 on carrier 40 for transverse adjustment of the tamping head in the direction of elongation of ties 4 to enable the tamping tools to be centered above rail 3 in curves. Tamping unit 25 is mounted glidably on vertical guide columns 47 and is vertically adjustable on carriage 24 by hydraulic jack 46 to enable the tamping tools to be immersed in the ballast for tamping. Additional track lifting mechanism 23 comprises tool carriage 44 mounted glidably on vertical track 45 affixed to carrier 41 and is vertically adjustable on this carrier by hydraulic jack 42 to enable roller clamps 43 on carriage 44 to lift the track when the roller clamps grip the track rails and jack 42 is operated. The other track lifting mechanism 22 similarly comprises tool carriage 50 and is vertically adjustable on tamping machine frame 20 by hydaulic jack 48 to enable roller clamps 49 on carriage 50 to lift the track forwardly of the tamping head when roller clamps 49 grip the track rails and jack 48 is operated.

Cab 51 is arranged on the ballast tamping machine to enable an operator to observe and control the tamping operation. Drives 52 and 53 are arranged to move endless conveyor bands 33 and 34 in a conveying direction.

In the embodiment illustrated in FIG. 3, means 54 adjustably couples the tamping machine frame to train 59 whereby tamping head 60 on the tamping machine frame is intermittently movable with respect to the non-stop movement of the train in the operating direction indicated by arrow 65. Adjustable coupling means 54 is shown arranged between ballast cleaning machine 55 and ballast tamping machine 56. The adjustable coupling means is shown as hydraulic jack 57 for selectively maintaining a constant distance between the ballast cleaning and tamping machines for common non-stop movement thereof, and a varying distance for permitting the tamping machine to discontinue movement while the train moves non-stop on the track.

Hydraulic jack 57 has a cylinder linked to one of the machines and a piston rod linked to the other machine, piston 58 gliding in the cylinder and dividing the same into two chambers respectively receiving controlled amounts of hydraulic fluid from a control circuit similar to the one described in connection with FIG. 1, thus providing a double-acting jack providing for controlled relative movement between the ballast cleaning and tamping machines 55 and 56. Tamping head 60 and additional track lifting mechanism 61 are mounted on ballast tamping machine 56 against longitudinal movement relative thereto, i.e. the tamping head and track lifting mechanism move along the track in unison with the ballast tamping machine. As in the other embodiment described hereinabove, train 59 also includes a series of freight cars 62 and conveyor means including first conveyor means section 64 arranged to convey the waste component along the series of freight cars and second conveyor means section 63 arranged on tamping machine 56. Arrows 66 indicate, on the one hand, the non-stop movement of cleaning machine 55 in the direction of arrow 65 and the intermittent movement of tamping machine 56 and freight cars 62 coupled thereto. The adjustable coupling 54 may be readily operated in controlled stages with the other hydraulic drives on the train.

The hereinabove described mobile apparatus enables the ballast supporting track 5 to be cleaned in accordance with the present invention by operating lifting mechanism 23 or 61 to lift a first section of the track and successively tamping the ballast under successive track ties 4 of the lifted first track section as the ballast tamping proceeds intermittently in an operating direction indicated by arrow 36 or 65 from tie to tie. Ballast cleaning machine 6 or 55 is moved non-stop on the track in the operating direction in a second and trailing track section while the track section is further lifted by track lifting mechanism 17 after the ballast has been tamped thereunder, the ballast is removed from under the lifted second track section by excavating chain 10, the removed ballast is cleaned on screening arrangement 10 and a waste component is separated from the cleaned ballast on this screening arrangement. The waste component is conveyed by endless conveyor band 13 and conveyor means 32, 35 or 63, 64 from the ballast cleaning machine over the first track section to a series of freight cars 8 or 62 arranged to receive and transport the waste component ahead of the first track section, the freight cars moving with the ballast cleaning machine in the operating direction.

This ballast cleaning method retains all the advantages obtained by modern ballast cleaning machines which continuously move along a track section to clean the ballast and simultaneously load the resultant waste on freight cars moving on the same track while, at the same time, avoiding permanent track rail deformations due to substantial track lifting strokes necessitated by shallow ballast beds. Furthermore, the method does not require substantial and expensive modifications in existing ballast cleaning and tamping apparatus, only a few simple structural accessories being required to adapt conventional machinery to produce the mobile apparatus of this invention. Any type of ballast bed, whether deep or shallow, may thus be advantageously cleaned in a single pass.

Referring to the embodiment illustrated in FIGS. 1 and 2, the operation will proceed in the following manner:

After train 1 has been moved to the working site where ballast 2 supporting track 5 is to be cleaned, track lifting mechanisms 22 and 23 are lowered and roller clamps 43 and 49 are pivoted into gripping engagement with track rails 3. Hydraulic jack drives 42 and 48 are then actuated to lift track 5 while the track rails remain gripped by clamps 43 and 49. After the operator in cab 51 has positioning tamping unit 25 to center the tamping tools over a track tie 4, hydraulic jack drive 46 is operated to immerse the tamping tools in the ballast and to tamp the ballast under tie 4. After the tie has been tamped, the tamping unit is raised and hydraulic jack drive 26 is actuated to move the tamping head from the left end position shown in broken lines in FIG. 2 to the right into the position shown in full lines, at which time the tamping cycle is repeated at the next succeeding tie. Since train 1 is moved non-stop in the direction of arrow 36 by operation of drive 11 of ballast cleaning machine 6, the tamping head is automatically moved during the tamping cycle along guide track 38 in relation to tamping machine frame 20 in the left end position. Rear swivel truck 21 supporting an end of ballast tamping machine 7 adjacent ballast cleaning machine 6 as well as the entire ballast cleaning machine move on the raised level of the track obtained by tamping ballast under the previously lifted track ties. Track lifting mechanism 17 engages the track in the range of transverse run 16 of excavating chain 10 to lift frame 18 of ballast cleaning machine 6 with track 5 off the provisional ballast supports for the track ties. The extent of the lifting stroke depends, on the one hand, on the depth of ballast 2 and, on the other hand, on the height of excavating chain run 16 extending transversely below the track. At any rate, track 5 must be lifted sufficiently to enable excavating chain run 16 to be accommodated under the track without touching the undersides of track ties 4. The excavated ballast is cleaned on screening arrangement 10 and the cleaned ballast is returned to the track by distributor conveyor 14 whose output end may be swung back and forth to cover the entire width of the track and its shoulders. The waste component discharged from the screening arrangement is conveyed by endless conveyor 13 towards ballast tamping machine 7 whence it is conveyed by conveyor sections 32 and 34 to conveyor section 35 for loading freight cars 8.

In the operation of train 59 illustrated in FIG. 3, ballast tamping machine 56 remains standing still during each tamping cycle while ballast cleaning machine 55 continues to move non-stop in the direction of arrow 65. This relative movement of machines 55 and 56 is made possible by moving piston 58 of adjustable coupling 54 in the direction of arrows 66 towards the ballast tamping machine. After tamping unit 61 has tamped a respective track tie lifted by mechanism 61, hydraulic fluid pressure is applied to piston 58 so that ballast tamping machine 56 and freight cars 62 coupled thereto are moved in the direction of arrow 65 at a speed exceeding the forward speed of ballast cleaning machine 55 until tamping unit 60 is centered over the next succeeding tie to repeat the tamping cycle. Conveyor means 63 mounted on tamping machine 56 projects beyond the ends of the tamping machine by a length at least equal to the distance traveled by ballast cleaning machine 55 during each tamping cycle. This enables the waste component to be continuously conveyed from the ballast cleaning machine to the freight cars.

What is claimed is:

1. A mobile apparatus for cleaning ballast supporting a track, which comprises a train arranged for non-stop movement on the track in an operating direction, the train including (a) a ballast cleaning machine comprising
  (1) a track lifting mechanism and
  (2) means for cleaning the ballast and for separating the cleaned ballast from a waste component,
(b) a series of freight cars arranged to receive and transport the waste component,
(c) a ballast tamping machine arranged between the ballast cleaning machine and the series of freight cars, the ballast tamping machine being arranged forwardly of the ballast cleaning machine in the operating direction and comprising
  (1) an additional track lifting mechanism and
  (2) a tamping head capable of intermittent movement along the track, and
(d) a conveyor means for conveying the waste component from the ballast cleaning machine to respective ones of the freight cars, the conveyor means comprising
  (1) a first conveyor means section arranged to convey the waste component along the series of freight cars and
  (2) a second conveyor means section arranged on the tamping machine, the second conveyor means section having an input end adjacent the ballast cleaning machine and arranged to receive the waste component therefrom, and an output end adjacent an input end of the first conveyor means section and arranged to deliver the waste component thereto.

2. The mobile ballast cleaning apparatus of claim 1, wherein the ballast tamping machine comprises a frame mounted for mobility on the track, the tamping head being mounted on the frame, and further comprising means for moving the tamping head along the frame intermittently with respect to the non-stop movement of the train.

3. The mobile ballast cleaning apparatus of claim 2, wherein the tamping head comprises a carriage intermittently movably mounted on the tamping machine frame with respect to the non-stop movement of the train, the additional track lifting mechanism being mounted on the intermittently movable carriage.

4. The mobile ballast cleaning apparatus of claim 3, wherein a front and a rear swivel truck support the ballast tamping machine frame for mobility on the track, and further comprising another track lifting mechanism mounted on the frame for common non-stop movement with the machine, the other track lifting mechanism being arranged frontward of the tamping head in the direction of the non-stop movement.

5. The mobile ballast cleaning apparatus of claim 1, wherein the ballast tamping machine comprises a frame mounted for mobility on the track, the tamping head being mounted on the frame, and further comprising means adjustably coupling the tamping machine frame to the train whereby the tamping head on the frame is intermittently movable with respect to the non-stop movement of the train.

6. The mobile ballast cleaning apparatus of claim 5, wherein the adjustable coupling means is arranged between the ballast cleaning and tamping machines.

7. The mobile ballast cleaning apparatus of claim 6, wherein the adjustable coupling means is a hydraulic jack for selectively maintaining a constant distance between the ballast cleaning and tamping machines for common non-stop movement thereof, and a varying distance for permitting the tamping machine to discontinue movement while the train moves non-stop on the track.

8. The mobile ballast cleaning apparatus of claim 1, further comprising a drive for moving the train non-stop on the track, a drive for intermittently driving the tamping head along the track, and a control for coordinating the intermittent drive with the non-stop drive.

9. The mobile ballast cleaning apparatus of claim 1, wherein the second conveyor means section comprises two endless conveyor bands independently mounted on the tamping machine, one of the endless conveyor bands having the input end and the other endless conveyor band having the output end.

10. The mobile ballast cleaning apparatus of claim 9, wherein the endless conveyor bands are fixedly mounted on the tamping machine.

11. A method of cleaning ballast supporting a track, which comprises the steps of (a) lifting a first section of the track and successively tamping the ballast under successive track ties of the lifted first track section as the ballast tamping proceeds intermittently in an operating direction from tie to tie, (b) moving a ballast cleaning machine non-stop on the track in the operating direction in a second and trailing track section while further lifting the track section after the ballast has been tamped thereunder, removing the ballast from under the lifted second track section, cleaning the removed ballast and separating a waste component from the cleaned ballast, and (c) conveying the waste component from the ballast cleaning machine over the first track section to a series of freight cars arranged to receive and transport the waste component ahead of the first track section, the freight cars moving with the ballast cleaning machine in the operating direction.

* * * * *